US010050386B1

(12) United States Patent
Pickel et al.

(10) Patent No.: US 10,050,386 B1
(45) Date of Patent: Aug. 14, 2018

(54) ELECTRICAL CONNECTOR THAT DAMPENS ELECTRICAL RESONANCE

(71) Applicants: TE CONNECTIVITY CORPORATION, Berwyn, PA (US); Tyco Electronics (Shanghai) Co., Ltd., Shanghai (CN)

(72) Inventors: Justin Dennis Pickel, Hummelstown, PA (US); Chad William Morgan, Carneys Point, NJ (US); Arturo Pachon Munoz, Hummelstown, PA (US); David Patrick Orris, Middletown, PA (US); Liang Huang, Chengdu (CN)

(73) Assignees: TE CONNECTIVITY CORPORATION, Berwyn, PA (US); TYCO ELECTRONICS (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 15/448,696

(22) Filed: Mar. 3, 2017

(30) Foreign Application Priority Data

Feb. 13, 2017 (CN) ..... 2017 1 0075844

(51) Int. Cl.

| | |
|---|---|
| ***H01R 13/648*** | (2006.01) |
| ***H01R 13/6473*** | (2011.01) |
| ***H01R 13/6471*** | (2011.01) |
| ***H01R 12/72*** | (2011.01) |
| ***H01R 12/70*** | (2011.01) |

(52) U.S. Cl.
CPC ..... *H01R 13/6473* (2013.01); *H01R 12/7082* (2013.01); *H01R 12/721* (2013.01); *H01R 13/6471* (2013.01)

(58) Field of Classification Search
CPC ..... H01R 23/688; H01R 13/6585; H01R 13/6471; H01R 13/514; H01R 13/65807; H01R 12/727
See application file for complete search history.

(56) References Cited

U.S. PATENT DOCUMENTS

| | | | | |
|---|---|---|---|---|
| 6,296,499 | B1 | 10/2001 | Hermann, Jr. et al. | |
| 6,425,766 | B1 * | 7/2002 | Panella | H05K 1/117 439/59 |
| 7,467,960 | B1 * | 12/2008 | Harlan | H01R 13/03 439/181 |
| 7,837,479 | B1 | 11/2010 | Millard et al. | |
| 8,083,553 | B2 * | 12/2011 | Manter | H01R 13/514 439/607.05 |

(Continued)

*Primary Examiner* — Xuong Chung Trans

(57) ABSTRACT

An electrical connector includes a housing and both signal conductors and ground conductors held by the housing. The ground conductors are arranged in an array with the signal conductors and provide electrical shielding between the signal conductors. The ground conductors have an electrically conductive metal body extending a length between a terminating end and a mating distal end. The ground conductors are configured to engage corresponding mating ground conductors of a mating connector at a contact location of the respective ground conductor. The ground conductors further include a damping segment disposed between the contact location and the mating distal end. The damping segment is characterized by a lossy coating at least partially covering the metal body to dissipate electrical energy.

20 Claims, 5 Drawing Sheets

(56) References Cited

U.S. PATENT DOCUMENTS

| | | | | |
|---|---|---|---|---|
| 8,231,411 | B1 * | 7/2012 | Westman | H01R 13/6471<br>439/108 |
| 8,430,691 | B2 * | 4/2013 | Davis | H01R 13/6585<br>439/607.09 |
| 8,864,521 | B2 * | 10/2014 | Atkinson | H01R 13/6471<br>439/607.07 |
| 9,742,088 | B1 * | 8/2017 | Pickel | H01R 13/03 |

* cited by examiner

ELECTRICAL CONNECTOR THAT DAMPENS ELECTRICAL RESONANCE

CROSS-REFERENCE TO RELATED APPLICATIONS

This application claims priority to Chinese Patent Application No. 201710075844.6, filed on 13 Feb. 2017, which is incorporated by reference herein in its entirety.

BACKGROUND OF THE INVENTION

The subject matter herein relates generally to electrical connectors that provide electrical damping by dissipating electrical energy from conductors of the connectors.

Some electrical connector systems utilize electrical connectors, such as board-mounted connectors, cable-mounted connectors, or the like, to interconnect two circuit boards, such as a motherboard and daughter card. The conductors of a first electrical connector are terminated to one circuit board and extend through a housing of the first electrical connector towards a mating end to engage mating conductors of a second connector that is terminated to the other circuit board.

Some known electrical connectors have electrical problems, particularly when transmitting at high data rates. For example, some electrical connectors utilize differential pair signal conductors to transfer high speed signals. Ground conductors improve signal integrity by providing electrical shielding between the signal conductors. However, electrical performance of known electrical connectors is inhibited by resonance spikes at certain frequencies when transmitting high speed electrical signals, even with the presence of ground conductors disposed between the signal conductors. For example, electrical energy (referred to herein as electrical resonance) may propagate along the current path defined by the ground conductors and/or the signal conductors, reflecting back and forth along the lengths of the conductors to cause a standing wave that degrades the signal transmission performance of the electrical connector.

A need remains for a high speed electrical connector having reliable performance.

BRIEF DESCRIPTION OF THE INVENTION

In an embodiment, an electrical connector is provided that includes a housing, signal conductors, and ground conductors. The signal conductors and ground conductors are held by the housing. The ground conductors are arranged in an array with the signal conductors and provide electrical shielding between the signal conductors. The ground conductors have an electrically conductive metal body extending a length between a terminating end and a mating distal end. The ground conductors are configured to engage corresponding mating ground conductors of a mating connector at a contact location of the respective ground conductor. The ground conductors further include a damping segment disposed between the contact location and the mating distal end. The damping segment is characterized by a lossy coating at least partially covering the metal body to dissipate electrical energy.

In another embodiment, an electrical connector is provided that includes a housing, signal conductors, and ground conductors. The signal conductors and ground conductors are held by the housing. The ground conductors are arranged in an array with the signal conductors. The ground conductors have an electrically conductive metal body extending a length between a terminating end and a mating distal end. The metal body includes a center wall and at least one side wall extending from the center wall to surround and electrically shield at least one of the signal conductors on at least two sides thereof. The ground conductors are configured to engage corresponding mating ground conductors of a mating connector at a contact location of the respective ground conductor. The ground conductors further includes a damping segment disposed along the center wall and the at least one side wall between the contact location and the mating distal end of the ground conductor. The damping segment is characterized by a lossy coating at least partially covering the metal body to dissipate electrical energy.

In a further embodiment, an electrical connector is provided that includes a housing, deflectable signal contact beams, and deflectable ground contact beams. The housing includes a card slot defined between a first side wall and a second side wall of the housing. The card slot is open at a mating end of the housing to receive a mating connector therein. The signal contact beams are held by the housing and extend from one or more of the first side wall or the second side wall at least partially into the card slot to engage the mating connector received within the card slot. The ground contact beams are held by the housing and arranged in an array with the signal contact beams along the one or more of the first side wall or the second side wall of the housing to provide electrical shielding between the signal contact beams. The ground contact beams have an electrically conductive metal body extending from a rear end of the card slot to a mating distal end of the ground contact beam. The ground contact beams are configured to engage corresponding mating ground conductors of the mating connector at a contact location of the respective ground contact beam. The ground contact beams further include a damping segment disposed between the contact location and the mating distal end. The damping segment is characterized by a lossy coating at least partially covering the metal body to dissipate electrical energy.

DETAILED DESCRIPTION OF THE INVENTION

Figure 1:
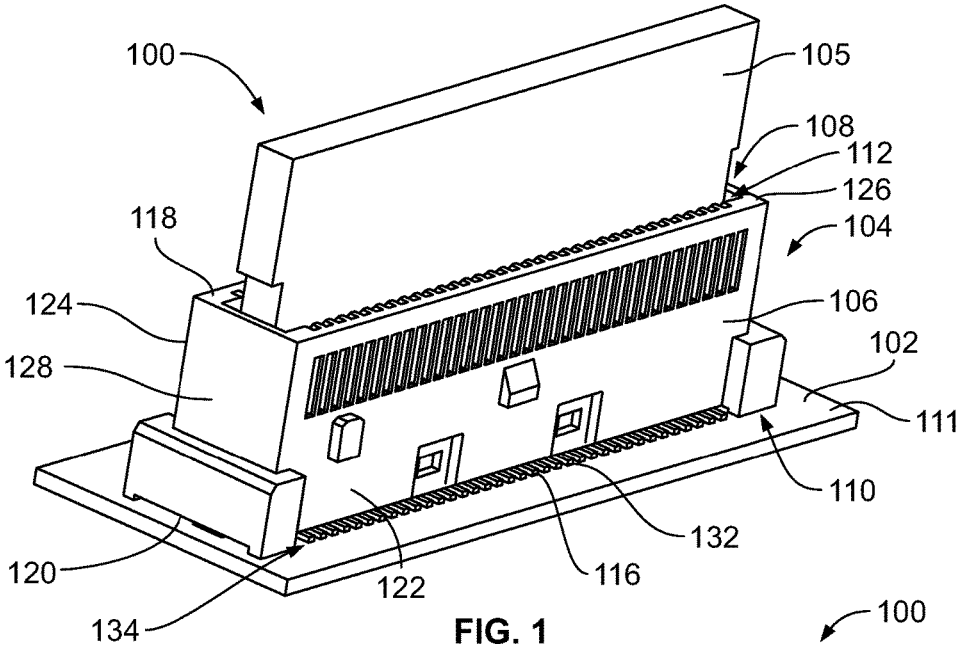
FIG. 1 is a top perspective view of an electrical connector system according to an embodiment showing a first electrical connector mated with a second electrical connector.
Figure 2:
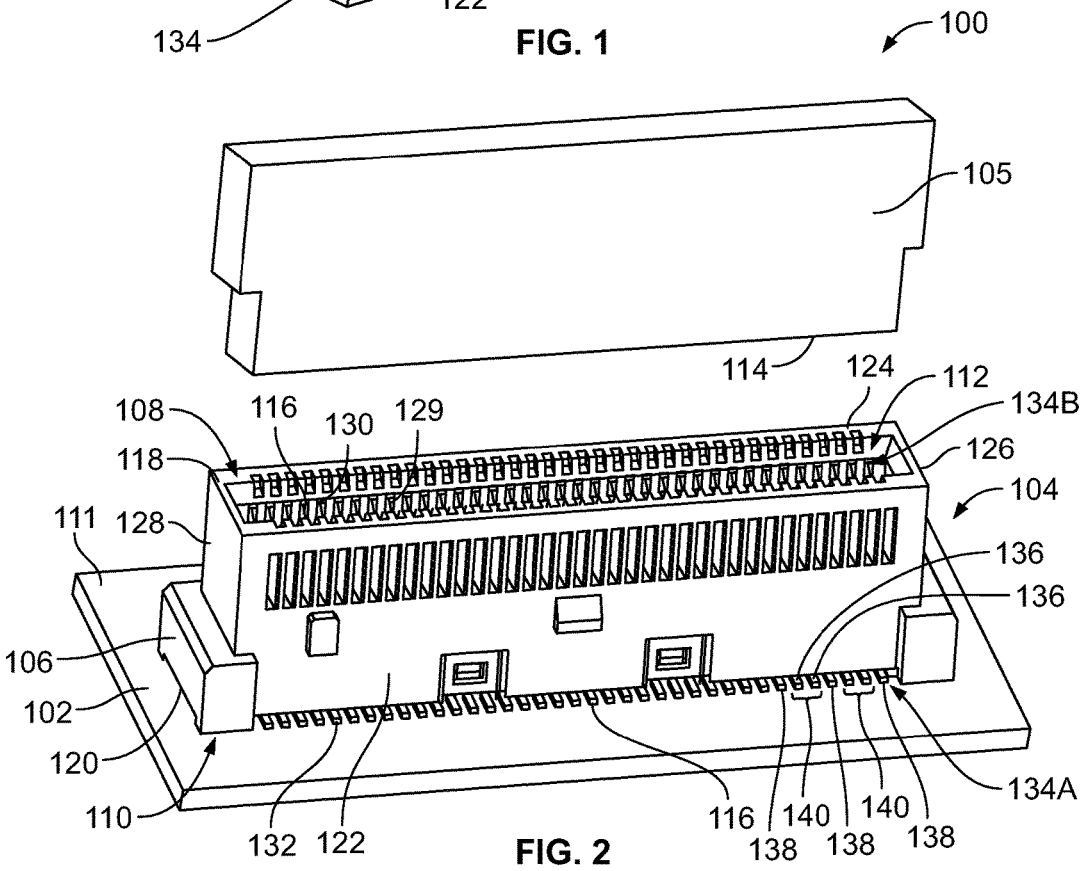
FIG. 2 is a top perspective view of the electrical connector system showing the second electrical connector poised for mating with the first electrical connector.

FIG. 1 is a top perspective view of an electrical connector system 100 according to an embodiment showing components in a mated state. FIG. 2 is a top perspective view of the electrical connector system 100 showing components in an unmated state. The electrical connector system 100 includes a circuit board 102 and a first electrical connector 104 mounted to the circuit board 102. The first electrical connector 104 is configured to electrically connect to a second electrical connector 105 (also referred to as mating connector 105) in order to provide an electrically conductive signal path between the circuit board 102 and the mating connector 105. The first electrical connector 104 may be a high speed connector that transmits data signals at speeds over 10 gigabits per second (Gbps), such as over 25 Gbps or over 35 Gbps. The electrical connector 104 may also be configured to transmit low speed data signals and/or power. The electrical connector 104 optionally may be an input-output (I/O) connector.

The first electrical connector 104 includes a housing 106 extending between a mating end 108 and a mounting end 110. The mounting end 110 is terminated to a top surface 111 of the circuit board 102. The mating end 108 defines an interface for connecting to the mating connector 105. In the illustrated embodiment, the mating end 108 defines a socket or card slot 112 that is configured to receive the mating connector 105 therein. For example, a front end of the mating connector 105 may be defined by a card edge 114 (FIG. 2) thereof. The card edge 114 may be an edge of a circuit card of the mating connector 105 having exposed conductors on one or both sides thereof configured to be plugged into the card slot 112. In other various embodiments, the card edge 114 may be an edge of a plug housing having exposed conductors on one or both sides thereof configured to be plugged into the card slot 112, or the card edge 114 may be another pluggable structure configured to be received in the card slot 112 for electrical connection with the electrical connector 104. Since the housing 106 of the electrical connector 104 defines the card slot 112 that receives the card edge 114 of the mating connector 105 therein, the first electrical connector 104 is referred to herein as receptacle connector 104, and the second, mating connector 105 is referred to herein as plug connector 105.

The receptacle connector 104, in the illustrated embodiment, is a vertical board-mount connector such that the card slot 112 is configured to receive the plug connector 105 in a loading direction that is transverse to, such as perpendicular to, the top surface 111 of the circuit board 102. In an alternative environment, the receptacle connector 104 may be a right-angle style connector that is configured to receive the plug connector 105 in a loading direction that is parallel to the top surface 111. In another alternative embodiment, the receptacle connector 104 may be terminated to an electrical cable instead of to the circuit board 102. Alternatively, the plug connector 105 may be a transceiver-style connector that is configured to be terminated to one or more cables, or a board-mount connector that is configured to be mounted directly to a surface of a circuit board.

The housing 106 of the receptacle connector 104 holds a plurality of contacts or conductors 116 held at least partially within the housing 106 and held, directly or indirectly, by the housing 106. The housing 106 extends between a top 118 and an opposite bottom 120. The top 118 defines the mating end 108 of the connector 104 such that the card slot 112 extends into the connector 104 via the top 118. The bottom 120 may define at least a portion of the mounting end 110 of the connector 104. For example, the bottom 120 abuts or at least faces the top surface 111 of the circuit board 102. The card slot 112 is defined by a first side wall 122, a second side wall 124, and first and second end walls 126, 128 that each extend between the side walls 122, 124. The side walls 122, 124 and end walls 126, 128 extend from the top 118 of the housing 106 towards the bottom 120. As used herein, relative or spatial terms, such as "front," "rear," "first," "second," "top," and "bottom," are only used to distinguish the referenced elements and do not necessarily require particular positions or orientations in the connector system 100 or the receptacle connector 104 relative to gravity or relative to the surrounding environment.

The conductors 116 of the receptacle connector 104 are configured to provide conductive paths through the receptacle connector 104 for signal transmission and grounding. For example, the conductors 116 are composed of an electrically conductive metal material, such as copper, silver, nickel, gold, or alloys thereof. The conductors 116 optionally may be stamped and formed from a sheet or panel of metal, molded, cast, or the like.

Each conductor 116 includes a deflectable contact beam or spring beam 129 which extends to a mating distal end 130 of the conductor 116. The contact beams 129 of the conductors 116 are configured to engage and electrically connect to a corresponding mating conductor (for example, a trace, contact pad, or mating contact) of the plug connector 105 within the card slot 112 when the plug connector 105 is fully mated to the receptacle connector 104. The deflectable contact beam 129 engages the mating conductor at a separable mating interface. The contact beams 129 are disposed within the card slot 112. The conductors 116 further include terminating ends 132 opposite to the mating distal ends 130. The terminating ends 132 are configured to be terminated to corresponding contact elements (not shown) of the circuit board 102 via thru-hole mounting to conductive vias, surface-mounting to conductive pads, and/or the like. In the illustrated embodiment, the terminating ends 132 of the conductors 116 are surface-mounted to pads on the top surface 111 of the circuit board 102, and may be soldered to the pads.

In an embodiment, the conductors 116 are organized in at least one array 134. The conductors 116 in a respective array 134 are arranged side-by-side in a row. In the illustrated embodiment, the conductors 116 are organized in two arrays 134. The only portions of the conductors 116 in a first contact array 134A of the two arrays 134 that are visible in FIG. 2 are the terminating ends 132, while the only portions of the conductors 116 in a second contact array 134B of the two arrays 134 that are visible are the mating distal ends 130. The mating distal ends 130 of the conductors 116 in the first array 134A (which are not shown) extend at least partially into the card slot 112 from the first side wall 122, and the mating ends 130 of the conductors 116 of the second array 134B extend at least partially into the card slot 112 from the second side wall 124. Thus, the mating distal ends 130 of the first array 134A of conductors 116 are configured to engage one side of the card edge 114 of the plug connector 105, while the mating ends 130 of the second array 134B of conductors 116 are configured to engage the opposite side of the card edge 114. The contact beams may be configured to deflect towards and/or at least partially into the respective side walls 122, 124 from which the contact beams extend in order to exert a biased retention force on the plug connector 105 to retain mechanical and electrical contact with the corresponding mating conductors. The card edge 114 of the plug connector 105 may be generally centered within the card slot 112 to balance the forces of the conductors 116.

The conductors 116 in each array 134 include signal conductors 136 and ground conductors 138. The signal conductors 136 are used to transmit signals that contain data. The ground conductors 138 provide electrical shielding between the signal conductors 136 and electrical grounding for the connector 104. The signal conductors 136 and the ground conductors 138 may be arranged in a repeating sequence along each of the arrays 134 depending on the configuration of the connector 104. For example, in the illustrated embodiment, the signal conductors 136 are arranged side-by-side in pairs 140, and a single ground conductor 138 is disposed between adjacent pairs 140 of signal conductors 136 to provide electrical shielding between the two pairs 140. Therefore, the signal conductors 136 and ground conductors 138 are arranged in a ground-signal-signal-ground-signal-signal configuration. In alternative embodiments, two ground conductors 138 may be disposed between the pairs 140 of signal conductors 136 (instead of one ground conductor 138), or the signal and ground conductors 136, 138 may alternate one-by-one along the array 134.

Figure 3:
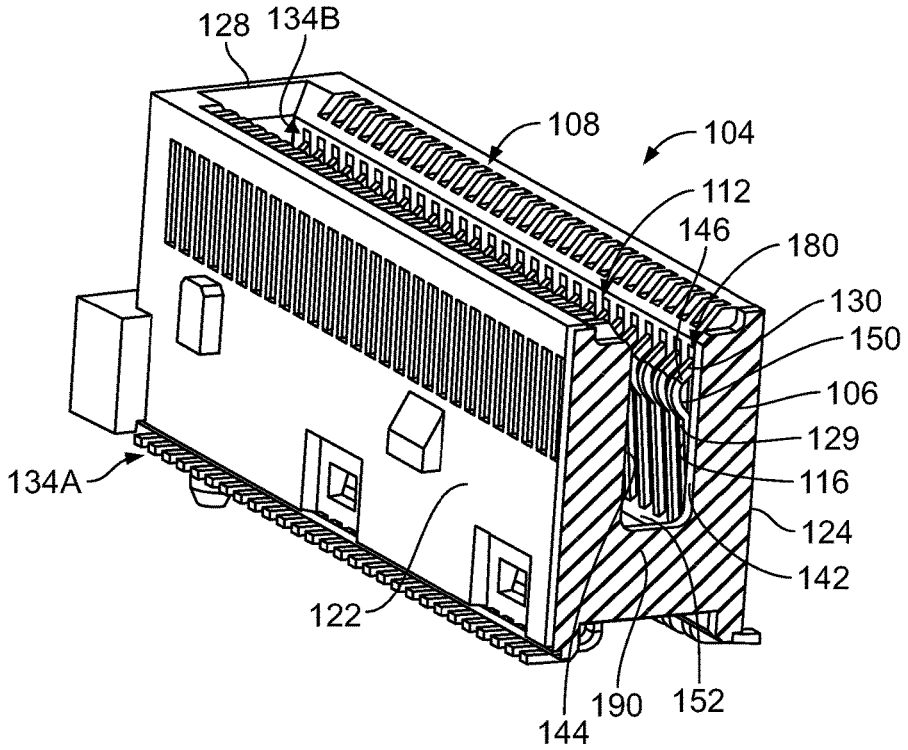
FIG. 3 is a partial sectional view of the first electrical connector in accordance with an embodiment.

FIG. 3 is a partial sectional view of the receptacle connector 104 in accordance with an embodiment. The housing 106 in the illustrated embodiment includes a base 190 extending between and connecting the side walls 122, 124. The base 190 is remote from the mating end 108 of the housing 106. For example, assuming that the mating end 108 is a front end of the card slot 112, the base 190 defines an opposite rear end 152 of the card slot 112. The base 190 ties the first and second side walls 122, 124 together to resist the first and second side walls 122, 124 bowing outward, such as when mated to the plug connector 105 (shown in FIGS. 1 and 2). Optionally, the base 190 may serve to position the plug connector 105 in the card slot 112. For example, the plug connector 105 may bottom out against the base 190 at the rear end 152 of the card slot 112 to define a fully mated position of the plug connector 105 relative to the receptacle connector 104. The housing 106 is composed of a dielectric material, such as one or more plastics. The housing 106 may be formed via a molding process or the like.

The deflectable contact beams 129 of the conductors 116 extend from the rear end 152 of the card slot 112 along the first side wall 122 and/or the second side wall 124. As shown in FIG. 3, only the deflectable contact beams 129 of the conductors 116 of the second array 134B that extend along the second side wall 124 are visible, but it is understood that the deflectable contact beams 129 of the conductors 116 of the first array 134A extend along the first side wall 122. In an alternative embodiment, the connector 104 may include only one array 134 of conductors 116 extending along either the first side wall 122 or the second side wall 124, but not both.

The contact beams 129 extend at least partially into the card slot 112 from the respective side walls 122, 124 to engage the plug connector 105 that is received in the card slot 112. In an embodiment, the contact beams 129 (of both the signal conductors 136 and the ground conductors 138 shown in FIG. 2) include a convex-shaped bend 150 located proximate to, but not at, the mating distal end 130 of the respective contact beam 129. The convex-shaped bends 150 of the contact beams 129 of the array 134B protrude into the card slot 112 beyond an interior surface 142 of the second side wall 124 that defines the card slot 112. The convex-shaped bends 150 of the contact beams 129 of the array 134B extend towards the first side wall 122. Although not shown, the convex-shaped bends 150 of the contact beams 129 of the array 134A protrude beyond an interior surface 144 of the first side wall 122 into the card slot 112 towards the second side wall 124. The convex-shaped bends 150 are configured to interface with the plug connector 105. For example, when the plug connector 105 is received in the card slot 112, each of the contact beams 129 engages a corresponding component or area of the plug connector 105 at a respective contact location, which is disposed along the convex-shaped bend 150.

In an embodiment, the contact beams 129 further include a bent tip 146 that extends from the convex-shaped bend 150 to the mating distal end 130 of the respective contact beam 129. The bent tips 146 of the contact beams 129 extend generally towards the respective side wall 122 or 124 along which each contact beam 129 extends. For example, the bent tips 146 of the contact beams 129 of the array 134B extend generally towards the second side wall 124. The bent tips 146 may be linear segments or curved segments. For example, the bent tips 146 may be extensions of the convex-shaped bend 150. The bent tips 146 are configured to provide lead-in segments that prevent the contact beams 129 from stubbing on the plug connector 105 as the plug connector 105 is loaded into the card slot 112. When the plug connector 105 is loaded into the card slot 112, the plug connector 105 engages the bent tips 146 and the convex-shaped bends 150, which deflects the contact beams 129 outward towards the respective side wall 122 or 124 along which each contact beam 129 extends. For example, the housing may include contact channels 180 defined along the side walls 122, 124, and the contact beams 129 may deflect at least partially into the corresponding contact channels 180 when the plug connector 105 is loaded into the card slot 112.

Figure 4:
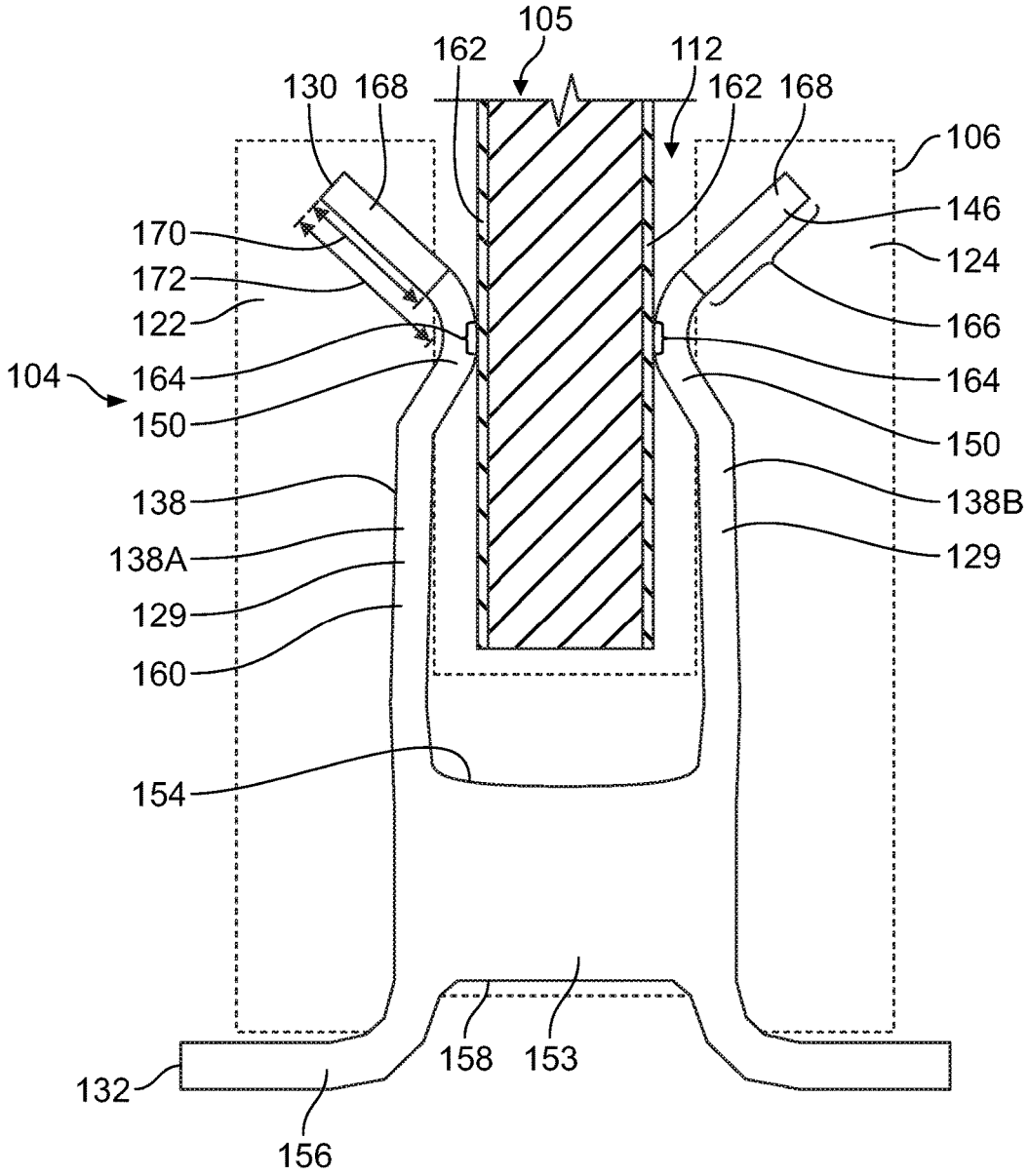
FIG. 4 is a partial sectional view showing the second electrical connector engaged by two opposing ground conductors of the first electrical connector according to an embodiment.

FIG. 4 is a partial sectional view showing the plug connector 105 engaged by two opposing ground conductors 138 of the receptacle connector 104 according to an embodiment. The housing 106 is shown in phantom, and the other conductors 116 of the connector 104 are not shown in FIG. 4. The two ground conductors 138 include a first ground conductor 138A that extends along the first side wall 122 and a second ground conductor 138B that extends along the second side wall 124. The ground conductors 138 each have a metal body 160 that extends between the mating distal end 130 and the terminating end 132 of the respective conductor 138. As described above, the metal body 160 may be composed of one or more metals, such as copper, silver, nickel, gold, or the like, including alloys thereof. In the illustrated embodiment, the two ground conductors 138 are mechanically and electrically connected to each other by a bridge 153. The contact beams 129 of the ground conductors 138 extend from a top end 154 of the bridge 153 to the mating distal ends 130 of the conductors 138. The ground conductors 138 have mounting segments or tails 156 that extend from a rear end 158 of the bridge 153 to the terminating ends 132 of the conductors 138. The bridge 153 is electrically conductive and provides a conductive path between the conductors 138 to electrically connect the conductors 138. The bridge 153 may be formed integral to the conductors 138 as a unitary, one-piece ground structure. For example, the receptacle connector 104 may include multiple such unitary ground structures interposed between individual signal conductors 136 (shown in FIG. 2) or pairs of signal conductors 136. In an alternative embodiment, the first and second ground conductors 138A, 138B are mechanically discrete and not connected to each other by the bridge 153.

The contact beams 129 of the first and second ground conductors 138A, 138B straddle the portion of the plug connector 105 that is received within the card slot 112 of the housing 106. The convex-shaped bends 150 engage corresponding mating ground conductors 162 on opposite sides of the plug connector 105. The mating ground conductors 162 may be traces, contact pads, mating contacts, or the like. The contact beams 129 of the ground conductors 138 engage the corresponding mating ground conductors 162 at respective contact locations 164 along the contact beams 129. The contact locations 164 define a separable mating interface between the contact beams 129 and the mating ground conductors 162. The contact locations 164 in the illustrated embodiment are disposed on the convex-shaped bends 150 of the contact beams 129.

The ground conductors 138 further include a respective damping segment 166 that is characterized by a lossy coating 168 on the metal body 160 of the respective ground conductor 138. In the illustrated embodiment, the damping segment 166 is defined along the bent tip 146 of each of the ground conductors 138. The damping segment 166 optionally also extends along a portion of the convex-shaped bend 150. The damping segment 166 is configured to reduce and dissipate electrical resonances that reflect back and forth along the lengths of the ground conductors 138. For example, without a damping segment 166, resonating electrical energy along the ground conductors 138 may reflect at the mating distal end 130 back along the ground conductors 138 towards the terminating ends 132. The electrical resonances may form a standing wave that interferes with the signal transmission through the receptacle connector 104. The amount of interference may be greater with high speed connectors, such as the receptacle connector 104, relative to lower speed connectors. The damping segments 166 dissipate at least some of the electrical energy that resonates along the ground conductors 138 between the contact locations 164 and the mating distal ends 130 to reduce unfavorable ground resonances within certain frequency bands of interest. For example, the damping segments 166 may dissipate electrical resonance above 10 GHz.

The lossy coating 168 is composed of a lossy material that provides lossy conductivity and/or magnetic lossiness through a portion of the receptacle connector 104. The lossy material has dielectric properties that vary with frequency. The lossy material has a loss tangent that is greater than a loss tangent of the (low loss) dielectric material of the housing 106. The lossy material is able to conduct electrical energy, but with at least some loss. The lossy material is less conductive than the conductive metal material of the conductors 138. The lossy material may include electrically conductive filler particles dispersed within a dielectric binder material. The dielectric binder material, such as an epoxy or another polymer, is used to hold the conductive filler particles in place. As used herein, the term "binder" encompasses material that encapsulates the filler or is impregnated with the filler. The binder material may be any material that will set, cure, or can otherwise be used to position the filler material. In one or more embodiments, the binder is a curable thermosetting polymer, such as an epoxy, an acrylic resin, or the like.

The conductive filler particles impart loss to the lossy coating 168. Examples of conductive particles that may be used as a filler to form electrically lossy materials include carbon or graphite formed as fibers, flakes, powders, or other particles. Metal in the form of powder, flakes, fibers, or other conductive particles may also be used as the conductive filler elements to provide suitable lossy properties. Alternatively, combinations of fillers may be used. For example, metal plated (or coated) particles may be used. Silver and nickel may also be used to plate particles. Plated (or coated) particles may be used alone or in combination with other fillers, such as carbon flakes. In some embodiments, the fillers may be present in a sufficient volume percentage to allow conducting paths to be created from particle to particle. For example when metal fiber is used, the fiber may be present at an amount up to 40% or more by volume.

In some embodiments, the lossy material may simultaneously be an electrically-lossy material and a magnetically-lossy material. For example, the lossy material may be composed of a binder material with magnetic particles dispersed therein to provide magnetic properties. The magnetic particles may be in the form of flakes, fibers, or the like. Materials such as magnesium ferrite, nickel ferrite, lithium ferrite, yttrium garnet and/or aluminum garnet may be used as magnetic particles. Such lossy materials may be formed, for example, by using magnetically-lossy filler particles that are partially conductive or by using a combination of magnetically-lossy and electrically-lossy filler particles.

In an embodiment, the damping segment 166 of the ground conductors 138 is formed subsequent to the formation of the metal bodies 160 of the ground conductors 138 by applying the lossy material to at least the bent tips 146 of the ground conductors 138 such that the lossy coating 168 covers at least a portion of the circumference or perimeter of the metal body 160. In one embodiment, the lossy coating 168 is applied in a two-step process that includes dipping the mating distal ends 130 of the ground conductors 138 in the lossy material when the lossy material is in a fluid state and subsequently thermally annealing to cure the lossy material on the ground conductors 138. In another embodiment, the lossy material may be painted, sprayed, or otherwise applied (such as electrostatically or magnetically) to the metal body 160 without dipping the metal body 160 into the lossy material. The lossy coating 168 optionally may surround and cover the entire perimeter of the metal body 160 along the damping segment 166, including the mating distal end 130. In an alternative embodiment, the lossy coating 168 does not surround the entire perimeter of the metal body 160, but rather covers a portion of the perimeter such as half or three-quarters of the perimeter of the metal body.

The thickness of the lossy coating 168 may be controlled to tune the electrical characteristics of the ground conductors 138. For example, the thickness and lossy properties of the lossy coating 168 may be selected to provide a desired amount of electrical energy absorption and dissipation while also limiting an amount of signal degradation (for example, insertion loss) that is caused by the lossy coating 168. In one or more embodiments, the lossy coating may have a thickness of less than about 0.5 mm, such as less than about 0.4 mm, less than about 0.2 mm, or less than about 0.1 mm.

The damping segment 166 extends a distance 170 from the mating distal end 130 towards the contact location 164 along the length of the ground conductor 138. In an embodiment, the damping segment 166 does not extend fully to the contact location 164, such that the distance 170 of the damping segment 166 is less than the full distance 172 from the mating distal end 130 to the contact location 164. As a result, the contact location 164 that engages the plug connector 105 is defined by the metal body 160. The lossy coating 168 does not cover the contact location 164 and does not engage the plug connector 105. In an embodiment, the lossy coating 168 of the damping segment 166 does cover most of the distance 172. For example, the distance 170 of the damping segment 166 is greater than half of the full distance 172. The uncoated region of the metal body 160 between the end of the damping segment 166 and the contact location 164 may accommodate for manufacturing and mating tolerances, ensuring that the lossy coating 168 does not contact the plug connector 105. In an alternative embodiment, however, the lossy coating 168 of the damping segment 166 may extend the full distance 172 from the mating distal end 130 to the contact location 164. In another alternative embodiment, the damping segment 166 does not extend fully to the mating distal end 130.

In an embodiment, the remainder of the length of each of the ground conductors 138 is not covered by any lossy coating. For example, the lossy coating 168 at least partially covers the metal body 160 along the damping segment 166, but the metal body 160 between the end of the damping segment 166 and the terminating end 132 is not at least partially covered by any lossy coating.

Figure 5:
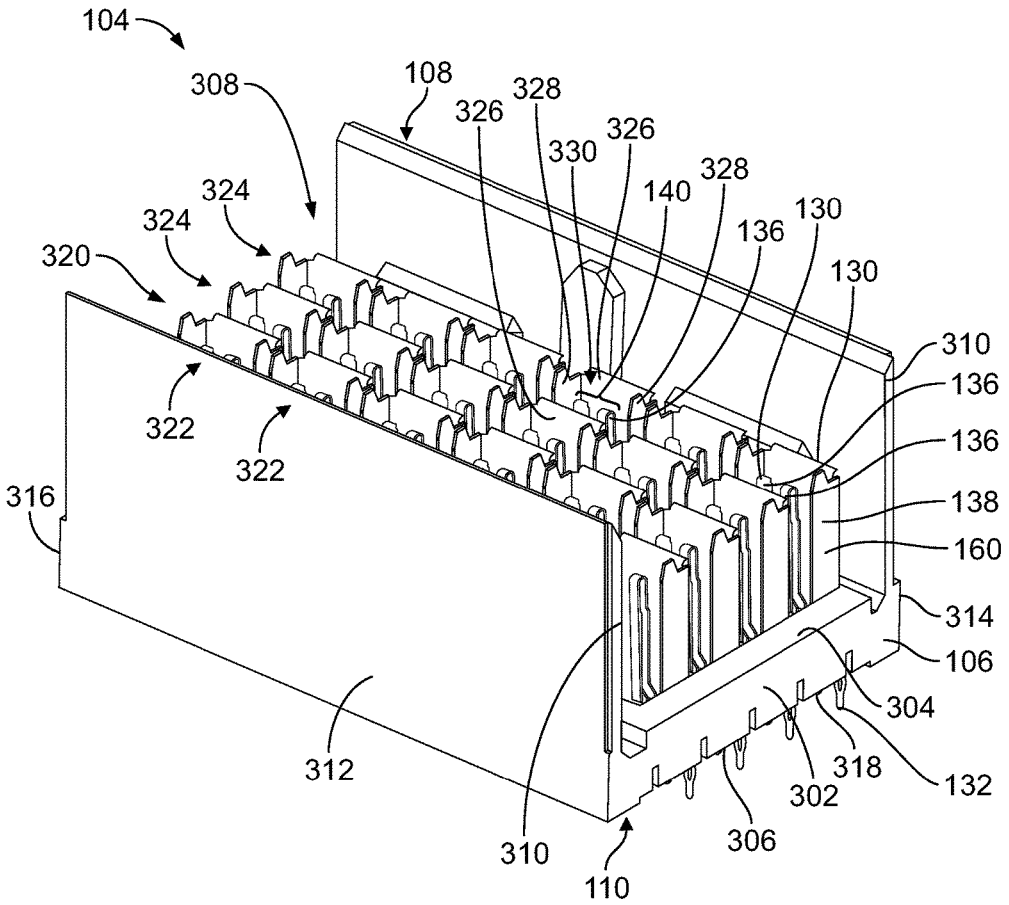
FIG. 5 is a perspective view of the first electrical connector according to an alternative embodiment.

FIG. 5 is a perspective view of the electrical connector 104 according to an alternative embodiment. The housing 106 of the electrical connector 104 extends between the mating end 108 and the mounting end 110, which is configured to be mounted to the circuit board 102 (shown in FIG. 1). In the illustrated embodiment, the housing 106 includes a base wall 302. The base wall 302 has a top side 304 and an opposite bottom side 306. The bottom side 306 faces the circuit board 102 and may define the mounting end 110. The base wall 302 of the housing 106 holds the signal conductors 136 and the ground conductors 138. The signal conductors 136 and the ground conductors 138 extend through the base wall 302. The mating distal ends 130 of the signal and ground conductors 136, 138 protrude beyond the top side 304 and are disposed within a cavity 308 defined by the housing 106. The terminating ends 132 of the signal and ground conductors 136, 138 protrude beyond the bottom side 306 of the base wall 302 for mechanically and electrically connecting to the circuit board 102.

The housing 106 extends a width between opposite first and second sides 312, 314 and extends a length between opposite first and second ends 316, 318. The housing includes shroud walls 310 that extend from the top side 304 of the base wall 302 along the sides 312, 314. The shroud walls 310 define the mating end 108 of the housing 106. The cavity 308 is defined by the shroud walls 310 and the top side 304 of the base wall 302. The signal and ground conductors 136, 138 are disposed between the two shroud walls 310 that are shown in FIG. 5. Optionally, the housing 106 may include additional shroud walls that extend along the ends 316, 318 to fully enclose a perimeter of the cavity 308. The cavity 308 is open at the mating end 108 to receive a corresponding mating connector (not shown) therein. In the illustrated embodiment, the electrical connector 104 is configured to receive a board-mounted mating connector instead of the mating connector 105 shown in FIG. 1. The shroud walls 310 may guide the board-mounted mating connector into the cavity 308 through the mating end 108 to engage the signal and ground conductors 136, 138.

In the illustrated embodiment, the metal bodies 160 of the ground conductors 138 have a center wall 326 and two side walls 328 that extend from respective lateral edges of the center wall 326. Each of the center wall 326 and the side walls 328 is generally planar. The side walls 328 may extend generally parallel to each other in a common direction from the center wall 326. Thus, the ground conductors 138 may be C-shields that have a C-shaped cross-section defined by a plane perpendicular to the center wall 326 and the two side walls 328. Optionally, the side walls 328 may be oriented at approximately right angles relative to the plane of the center wall 326. The ground conductor 138 may be stamped and formed from a sheet of metal. For example, the center wall 326 may be formed integral to the side walls 328, and the side walls 328 are bent out of plane from the center wall 326 to define the side walls 328. Interior surfaces of the center wall 326 and the two side walls 328 define a channel 330 in which one or more of the signal conductors 136 are located.

The signal conductors 136 and ground conductors 138 are arranged in an array 320 that includes multiple columns 322 extending between the first and second sides 312, 314 and multiple rows 324 extending between the first and second ends 316, 318. Lengths of the signal conductors 136 and the ground conductors 138 are exposed within the cavity 308 for connecting to corresponding mating conductors of the mating connector. In the illustrated embodiment, each C-shaped ground conductor 138 surrounds a pair 140 of signal conductors 136 located within the channel 330 of the ground conductor 138. Each ground conductor 138 surrounds the corresponding pair 140 on three sides thereof to electrically shield the two signal conductors 136 from other signal conductors 136 in the array 320. The center wall 326 of an adjacent C-shaped ground conductor 138 in the same column 322 may shield the pair 140 of signal conductors 136 along a fourth side. The C-shaped ground conductors 138 may each surround only one or more than two signal conductors 138 in other embodiments.

Figure 6:
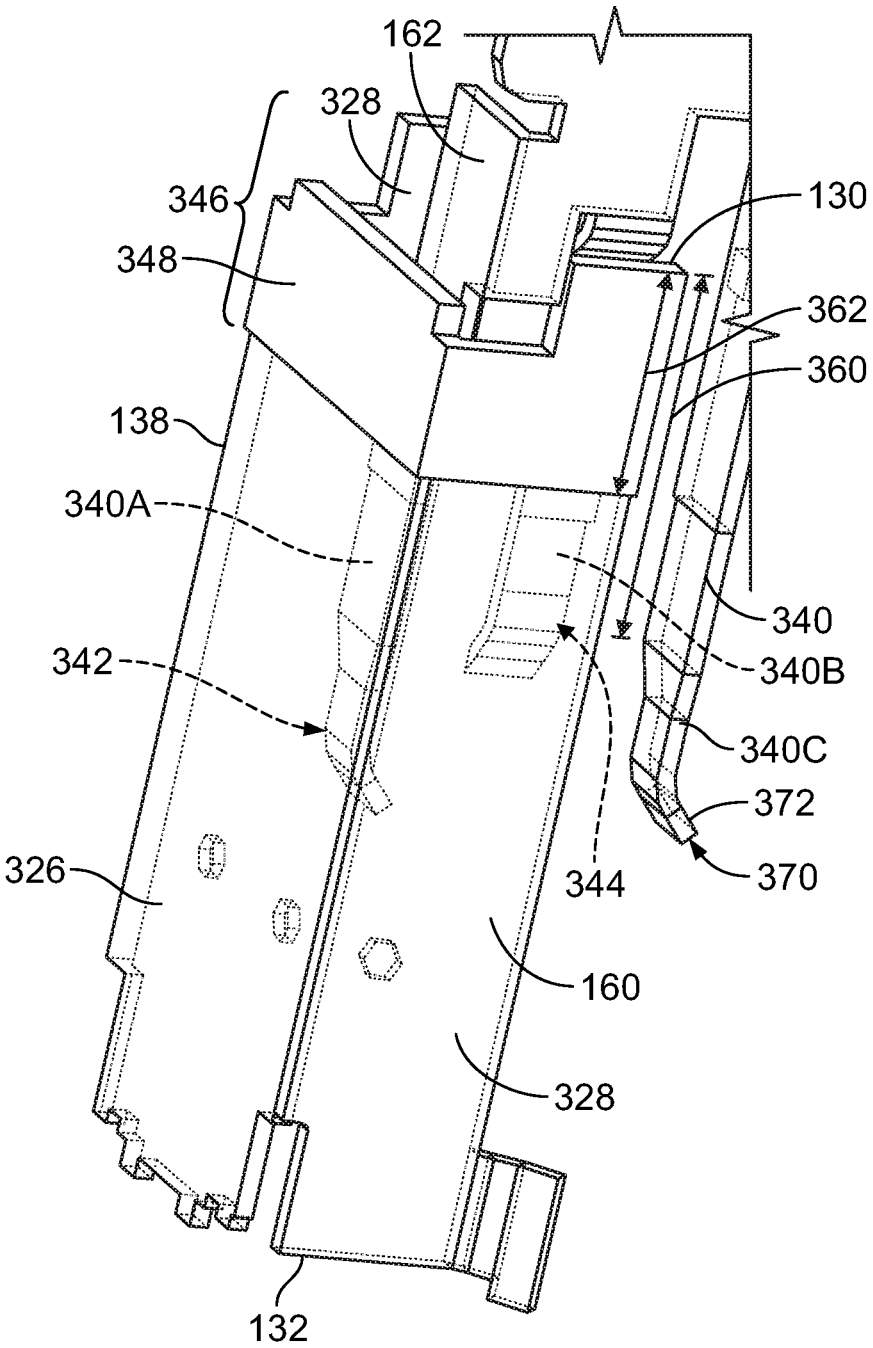
FIG. 6 is a perspective view of one ground conductor of the first electrical connector according to embodiment shown in FIG. 5 in engagement with a mating ground conductor of a second electrical connector.

FIG. 6 is a perspective view of one of the C-shield ground conductors 138 of the embodiment of the electrical connector 104 shown in FIG. 5 in engagement with a mating ground conductor 162 of the mating connector. The remaining components of the electrical connector 104, including the housing 106, the signal conductors 136, and the other ground conductors 138, which are shown in FIG. 5, are not shown in FIG. 6. In the illustrated embodiment, the mating ground conductor 162 includes multiple contact beams 340. Two of the contact beams 340A, 340B engage interior surfaces of the center wall 326 and one of the side walls 328 of the C-shield ground conductor 138, respectively. The segments of the two contact beams 340A, 340B behind the walls 326, 328 of the C-shield ground conductors 138 are shown in phantom in FIG. 6. A third contact beam 340C of the mating ground conductor 162 is configured to engage an adjacent C-shield ground conductor 138 in the array 320 (shown in FIG. 5). The contact beam 340A engages the center wall 326 at a first contact location 342, and the contact beam 340B engages the side wall 328 at a second contact location 344. The contact beams 340A, 340B engage the C-shield ground conductor 138 to provide a conductive ground path between the electrical connector 104 and the mating connector.

In an embodiment, to reduce interference caused by ground resonances, the C-shield ground conductor 138 includes a damping segment 346 that is characterized by a lossy coating 348 on the metal body 160 of the ground conductor 138. The damping segment 346 is configured to reduce and dissipate electrical resonances that reflect back and forth along the lengths of the C-shield ground conductors 138 between at least the mating distal end 130 and the contact locations 342, 344. The damping segment 346 is configured to reduce unfavorable ground resonances within certain frequency bands of interest, such as, for example, above 10 GHz. The lossy coating of the damping segment 346 may be similar in composition, application, and/or thickness to the lossy coating of the damping segment 166 described with reference to FIG. 4. For example, the lossy coating of the damping segment 346 at least partially covers the metal body 160 of the C-shield ground conductor 138, and may fully surround the portion of the metal body 160 within the damping segment 346.

In the illustrated embodiment, the damping segment 346 extends along the center wall 326 and both side walls 328. The damping segment 346 extends a length of the C-shield ground conductor 138 from the mating distal end 130 towards the contact locations 342 and 344. The contact location 344 is disposed more proximate to the mating distal end 130 than the proximity of the contact location 342 to the mating distal end 130, such that the contact location 344 is closer to the mating distal end 130. The contact location 344 is spaced apart from the mating distal end 130 by a first distance 360. In an embodiment, the damping segment 346 extends from the mating distal end 130 a second distance 362 that is less than the first distance 360, such that the lossy coating 348 does not cover the metal body 160 at the contact location 344. Optionally, the second distance 362 is greater than half of the first distance 360 such that the damping segment 346 extends most of the distance 360 from the mating distal end 130 to the contact location 344. In the illustrated embodiment, the metal body 160 of the C-shield ground conductor 138 is not covered by any lossy coating outside of the damping segment 346, such as between the end of the damping segment 346 and the terminating end 132 of the ground conductor 138.

Optionally, as illustrated on the contact beam 340C, the contact beams 340 of the mating ground conductor 162 may also include damping segments 370 that include a lossy coating 372 covering the metal contact beams 340. The damping segments 370 may be similar to the damping segments 166 of the contact beams 129 shown in FIG. 4. The lossy coating 372 of the damping segments 370 may provide additional electrical energy dissipation to reduce interference within the frequency bands of interest.

In an alternative embodiment, instead of the C-shield ground conductors 138 shown in FIGS. 5 and 6, the ground conductors 138 can be L-shield ground conductors (referred to herein as L-shields) that include a center wall and only one side wall extending from the center wall. The L-shields may be oriented in a matrix or grid-style array similar to the array 320 shown in FIG. 5. For example, a first L-shield surrounds a pair 140 of signal conductors 136 on two sides thereof to electrically shield the pair 140 from other signal conductors 136 in the array. The center wall of an adjacent L-shield in the same column as the first L-shield may shield the pair 140 of signal conductors 136 along an open third side of the pair 140. The side wall of an adjacent L-shield in the same row as the first L-shield may shield the pair 140 of signal conductors 136 along an open fourth side of the pair 140, such that the signal conductors 136 of the pair 140 are effectively shielded along all four sides. Although the L-shields differ from the C-shields in the number of walls, the L-shields can have damping segments with a lossy coating similar to the damping segments of the C-shields described in FIG. 6.

The above described embodiments provide an electrical connector that provides a lossy coating along distal damping segments of the ground conductors. The lossy coating absorbs and dissipates at least some energy that resonates along the current path defined by the signal and ground conductors to provide lossy conductivity and/or magnetic lossiness. The lossy coating provides electrical loss in a certain, targeted frequency range. Electrical performance of the electrical connector is enhanced by the inclusion of the lossy coating along the damping segments of the ground conductors. For example, the lossy coating of the ground conductors may dissipate energy that is reflected in a space on either side of a signal pair, which may enhance connector performance and throughput.

Although the ground conductors described herein have deflectable contact beams or C-shields, the electrical connector 104 according to other embodiments may have ground conductors that have different shapes, such as linear pins, single planar blades, or the like. It is understood that such other ground conductors may still be formed with damping segments of lossy coating as described herein. For example, the a planar blade ground conductor may be coated with a lossy material in a damping segment that is disposed between a distal mating end of the planar blade and a contact location where the blade makes physical contact with a mating conductor.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a housing;

signal conductors held by the housing; and ground conductors held by the housing, the ground conductors arranged in an array with the signal conductors and providing electrical shielding between the signal conductors, the ground conductors having an electrically conductive metal body extending a length between a terminating end and a mating distal end, the metal body of each of the ground conductors configured to engage a corresponding mating ground conductor of a mating connector at a contact location of the respective ground conductor when fully mated to the mating connector to provide a ground path along the respective ground conductor from the contact location to the terminating end of the ground conductor, the contact location of each ground conductor being spaced apart from the mating distal end of the ground conductor, the ground conductors further including a damping segment disposed outside of the ground path between the contact location and the mating distal end, the damping segment characterized by a lossy coating at least partially covering the metal body to dissipate electrical energy.

2. The electrical connector of claim 1, wherein the damping segments of the ground conductors do not engage the corresponding mating ground conductors when fully mated to the mating connector.

3. The electrical connector of claim 1, wherein the metal body of the ground conductors is not at least partially covered by the lossy coating between the damping segment and the terminating end of the ground conductors.

4. The electrical connector of claim 1, wherein the contact location of the ground conductors is spaced apart from the mating distal end of the corresponding ground conductor by a first distance, the damping segment extending along the length of the corresponding ground conductor from the mating distal end towards the contact location for a second distance that is less than the first distance.

5. The electrical connector of claim 4, wherein the second distance is greater than half of the first distance such that the damping segment extends most of the distance from the mating distal end to the contact location.

6. The electrical connector of claim 1, wherein the lossy coating fully surrounds the metal body of the ground conductors within the damping segment of the corresponding ground conductor.

7. The electrical connector of claim 1, wherein the ground conductors have a center wall and at least one side wall extending from the center wall to surround at least one of the signal conductors on at least two sides thereof, the damping segment extending along the center wall and the at least one side wall.

8. The electrical connector of claim 1, wherein the housing includes a card slot defined between a first side wall and a second side wall of the housing, the ground conductors including deflectable contact beams extending to the mating distal ends, the contact beams extending from one or more of the first side wall or the second side wall at least partially into the card slot to engage the mating connector that is received within the card slot.

9. The electrical connector of claim 8, wherein the deflectable contact beams of the ground conductors include a convex-shaped bend extending into the card slot and a bent tip extending from the convex-shaped bend to the mating distal end to prevent stubbing with the mating connector, the contact location of the ground conductor disposed on the convex-shaped bend, the damping segment defined along the bent tip.

10. The electrical connector of claim 1, wherein the lossy coating has a thickness less than 0.4 mm.

11. An electrical connector comprising:

a housing;

signal conductors held by the housing; and ground conductors held by the housing, the ground conductors arranged in an array with the signal conductors, the ground conductors having an electrically conductive metal body extending a length between a terminating end and a mating distal end, the metal body including a center wall and at least one side wall extending from the center wall to surround and electrically shield at least one of the signal conductors on at least two sides thereof, the metal body of each of the ground conductors configured to engage a corresponding mating ground conductor of a mating connector at a contact location of the respective ground conductor when fully mated to the mating connector to provide a ground path along the respective ground conductor from the contact location to the terminating end of the ground conductor, the contact location of each ground conductor being spaced apart from the mating distal end of the ground conductor, the ground conductors further including a damping segment disposed along the center wall and the at least one side wall outside of the ground path between the contact location and the mating distal end of the ground conductor, the damping segment characterized by a lossy coating at least partially covering the metal body to dissipate electrical energy.

12. The electrical connector of claim 11, wherein the metal body of the ground conductors is a C-shield that includes two side walls extending from opposite edges of the center wall to surround and electrically shield the at least one signal conductor on three sides thereof.

13. The electrical connector of claim 11, wherein the contact location of the ground conductors is spaced apart from the mating distal end of the corresponding ground conductor by a first distance, the damping segment extending along the length of the corresponding ground conductor from the mating distal end towards the contact location for a second distance that is less than the first distance.

14. The electrical connector of claim 13, wherein the second distance is greater than half of the first distance such that the damping segment extends most of the distance from the mating distal end to the contact location.

15. The electrical connector of claim 11, wherein the lossy coating fully surrounds the metal bodies of the ground conductors within the damping segments of the ground conductors.

16. An electrical connector comprising:

a housing including a card slot defined between a first side wall and a second side wall of the housing, the card slot open at a mating end of the housing to receive a mating connector therein;

deflectable signal contact beams held by the housing and extending from one or more of the first side wall or the second side wall at least partially into the card slot to engage the mating connector received within the card slot; and deflectable ground contact beams held by the housing and arranged in an array with the signal contact beams along the one or more of the first side wall or the second side wall of the housing, the ground contact beams providing electrical shielding between the signal contact beams, the ground contact beams having an electrically conductive metal body extending from the housing to a mating distal end of the ground contact beam, the metal body of each of the ground contact beams configured to engage a corresponding mating ground conductor of the mating connector at a contact location of the respective ground contact beam that is spaced apart from the mating distal end when fully mated to the mating connector, the ground contact beams providing ground paths along the ground contact beams from the respective contact locations into the housing, the ground contact beams further including a damping segment disposed outside of the ground path between the contact location and the mating distal end, the damping segment characterized by a lossy coating at least partially covering the metal body to dissipate electrical energy.

17. The electrical connector of claim 16, wherein the ground contact beams include a convex-shaped bend extending into the card slot and a bent tip extending from the convex-shaped bend to the mating distal end to prevent stubbing with the mating connector, the contact location of the ground conductor disposed on the convex-shaped bend, the damping segment defined along the bent tip.

18. The electrical connector of claim 16, wherein the array includes at least one ground contact beam disposed between adjacent pairs of signal contact beams along the one or more of the first side wall or the second side wall.

19. The electrical connector of claim 16, wherein the contact location of the ground contact beams is spaced apart from the mating distal end of the corresponding ground contact beam by a first distance, the damping segment extending along a length of the corresponding ground contact beam from the mating distal end towards the contact location for a second distance that is less than the first distance.

20. The electrical connector of claim 16, wherein the lossy coating fully surrounds the metal body of the ground contact beams within the damping segment of the corresponding ground contact beam.

* * * * *